US009914569B1

(12) United States Patent
Lin

(10) Patent No.: US 9,914,569 B1
(45) Date of Patent: Mar. 13, 2018

(54) PLASTIC SOFT TUBE WITH A CAP STRUCTURE ABLE TO CONTROL OUTFLOW

(71) Applicant: Xiamen Royal Tech Packaging Co., Ltd., Xiamen (CN)

(72) Inventor: Tiaohui Lin, Xiamen (CN)

(73) Assignee: XIAMEN ROYAL TECH PACKAGING CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/260,327

(22) Filed: Sep. 9, 2016

(51) Int. Cl.

| | |
|---|---|
| ***B65D 51/16*** | (2006.01) |
| ***B65D 41/04*** | (2006.01) |
| ***B65D 47/20*** | (2006.01) |
| ***B65D 35/44*** | (2006.01) |
| ***B65D 47/12*** | (2006.01) |
| ***A45D 40/00*** | (2006.01) |

(52) U.S. Cl.
CPC ..... *B65D 47/2012* (2013.01); *A45D 40/00* (2013.01); *B65D 35/44* (2013.01); *B65D 41/04* (2013.01); *B65D 47/12* (2013.01)

(58) Field of Classification Search
CPC .... B65D 47/2012; B65D 35/44; B65D 41/04; B65D 47/12; A45D 40/00
USPC ..... 220/810, 253, 254.8, 259.4
See application file for complete search history.

(56) References Cited

U.S. PATENT DOCUMENTS

| | | | | |
|---|---|---|---|---|
| 5,004,127 | A * | 4/1991 | Morel | B05B 11/0027 222/505 |
| 5,111,977 | A * | 5/1992 | Maguire | B65D 47/244 222/519 |
| 6,135,318 | A * | 10/2000 | Valley | B65D 47/242 222/48 |
| 7,229,229 | B2 * | 6/2007 | Wang | B05B 11/047 401/262 |
| 7,419,323 | B1 * | 9/2008 | Zhang | A45D 34/042 401/183 |
| 2013/0233896 | A1 * | 9/2013 | Benoit-Gonin | B65D 47/242 222/520 |
| 2014/0144949 | A1 * | 5/2014 | Skillin | B65D 47/242 222/521 |
| 2015/0034673 | A1 * | 2/2015 | Hopkins | B65D 47/243 222/129 |
| 2015/0232243 | A1 * | 8/2015 | Lee | B65D 51/2864 206/221 |
| 2016/0214770 | A1 * | 7/2016 | Cutts | B65D 35/44 |

(Continued)

*Primary Examiner* — J. Gregory Pickett
*Assistant Examiner* — Niki M Eloshway
(74) *Attorney, Agent, or Firm* — Leong C. Lei

(57) ABSTRACT

A plastic soft tube with a cap structure able to control outflow includes a tube main body, a main body connector having an outlet, and an outer cap. The main body connector is provided with an inner cap and a middle cap fitted on the inner cap. The inner cap includes a protruding post. The protruding post has a first passageway. A lower end of the protruding post is connected with a protrusion for the first passageway selectively to communicate with the outlet or not to communicate with the outlet. The middle cap has a post hole corresponding to the protruding post. The middle cap and the inner cap are movably mated with each other. When the middle cap is turned, the inner cap is brought to move up and down relative to the main body connector for controlling the outflow of the liquid or paste.

8 Claims, 7 Drawing Sheets

(56) References Cited

U.S. PATENT DOCUMENTS

| | | | | |
|---|---|---|---|---|
| 2016/0304250 | A1* | 10/2016 | Simpson | B65D 77/225 |
| 2016/0376069 | A1* | 12/2016 | Jung | A45D 34/04 401/261 |
| 2017/0152084 | A1* | 6/2017 | Giovannini | B65D 51/2864 |

* cited by examiner

PLASTIC SOFT TUBE WITH A CAP STRUCTURE ABLE TO CONTROL OUTFLOW

BACKGROUND OF THE INVENTION

1. Field of the Invention

The present invention relates to a liquid or paste packing structure, and more particularly to a plastic soft tube with a cap structure able to control outflow.

2. Description of the Prior Art

Soft tube packing is light in weight and convenient in use, not only used for food packing but also used for daily necessity packaging, such as cosmetics, toothpaste, shoe polish, etc.

A soft tube structure usually comprises a soft tube, a tube neck integrated with the soft tube, and a fitted cap to mate with the tube neck. When in use, the cap is directly opened and the soft tube is squeezed. The outflow of the content in the soft tube depends on the applied force and the size of the outlet of the soft tube. Different users may have different demands for the outflow of the content. If the outlet is bigger or the force is exerted too much, the outflow of the content will be much to cause a waste. If the outflow is refilled into the soft tube, it is inconvenient for operation and the content may be contaminated. For some special contents, this may affect the efficacy of its subsequent use and have a certain influence on the shelf life of the contents. If the outlet is smaller, in actual use, the outflow of the content for one time will not be enough. The user has to squeeze the soft tube repeatedly. It is inconvenient for use.

Accordingly, the inventor of the present invention has devoted himself based on his many years of practical experiences to solve these problems.

SUMMARY OF THE INVENTION

The primary object of the present invention is to provide a plastic soft tube with a cap structure able to control the outflow of the liquid or paste in the tube effectively.

In order to achieve the aforesaid object, the present invention comprises a tube main body, a main body connector integrated with the tube main body, and an outer cap fitted on the main body connector. The main body connector is provided with an inner cap screwed to the main body connector and a middle cap connected to the main body connector and fitted on the inner cap. The main body connector has an outlet therein. The inner cap comprises a protruding post thereon. The protruding post has a first passageway therein. A lower end of the protruding post is connected with a protrusion for the first passageway selectively to communicate with the outlet or not to communicate with the outlet. The middle cap has a post hole corresponding to the protruding post. The middle cap and the inner cap are movably mated with each other. When the middle cap is turned, the inner cap is brought to move up and down relative to the main body connector.

Preferably, the protrusion is in a pillar configuration or a taper configuration, and the outlet is a pillar configuration or a taper configuration corresponding to the protrusion.

Preferably, the inner cap has a cap body corresponding to the main body connector. An outer wall of the cap body is formed with at least one groove. The middle cap has an accommodation space therein corresponding to the cap body of the inner cap. An inner wall of the accommodation space is provided with at least one engaging block corresponding to the groove of the cap body of the inner cap.

Preferably, the accommodation space of the middle cap is greater than the cap body of the inner cap.

Preferably, a periphery of the junction of the protruding post and the protrusion is formed with at least one perforation in communication with the first passageway of the protruding post.

Preferably, the plastic soft tube with a cap structure able to control outflow further comprises an inner fitting head connected to the post hole of the middle cap and an outer fitting head fitted on the inner fitting head.

Preferably, the inner fitting head has a connecting section corresponding to the post hole of the middle cap. The connecting section has an accommodation hole to accommodate the protruding post of the inner cap. An upper end of the accommodation hole is formed with a second passageway in communication with the accommodation hole. A lower end of the outer fitting head is formed with a coupling hole to connect with the inner fitting head. An upper end of the coupling hole is formed with a third passageway in communication with the coupling hole.

Preferably, the inner fitting head and the outer fitting head are an integral whole.

Preferably, the main body connector relative to the tube main body from bottom to top is provided with a first neck to mate with the outer cap, a second neck to mate with the middle cap, and a third neck to mate with the inner cap. Outer edges of the first neck and the second neck are formed with flanges to mate with the outer cap and the middle cap. An outer wall of the third neck is formed with outer threads. An inner wall of the cap body is formed with inner threads to mate with the outer threads of the third neck.

Preferably, an inner side of the main body connector, between the second neck and the third neck, is provided with a baffle. The outlet is formed on the baffle.

Accordingly, the middle cap and the inner cap are connected together through engagement of the engaging block and the groove. When the middle cap is turned, the inner cap will be turned along with the middle cap, such that the inner cap is turned upward relative to the main body connector. By controlling the rotation of the outer cap, the gap between the protrusion of the protruding post of the inner cap and the outlet of the main body connector is controllable so as to control the outflow of the liquid or paste in the tube main body.

Additionally, the present invention is further provided with an outer fitting head for the liquid or paste to be smeared conveniently.

DETAILED DESCRIPTION OF THE PREFERRED EMBODIMENTS

Figure 1:
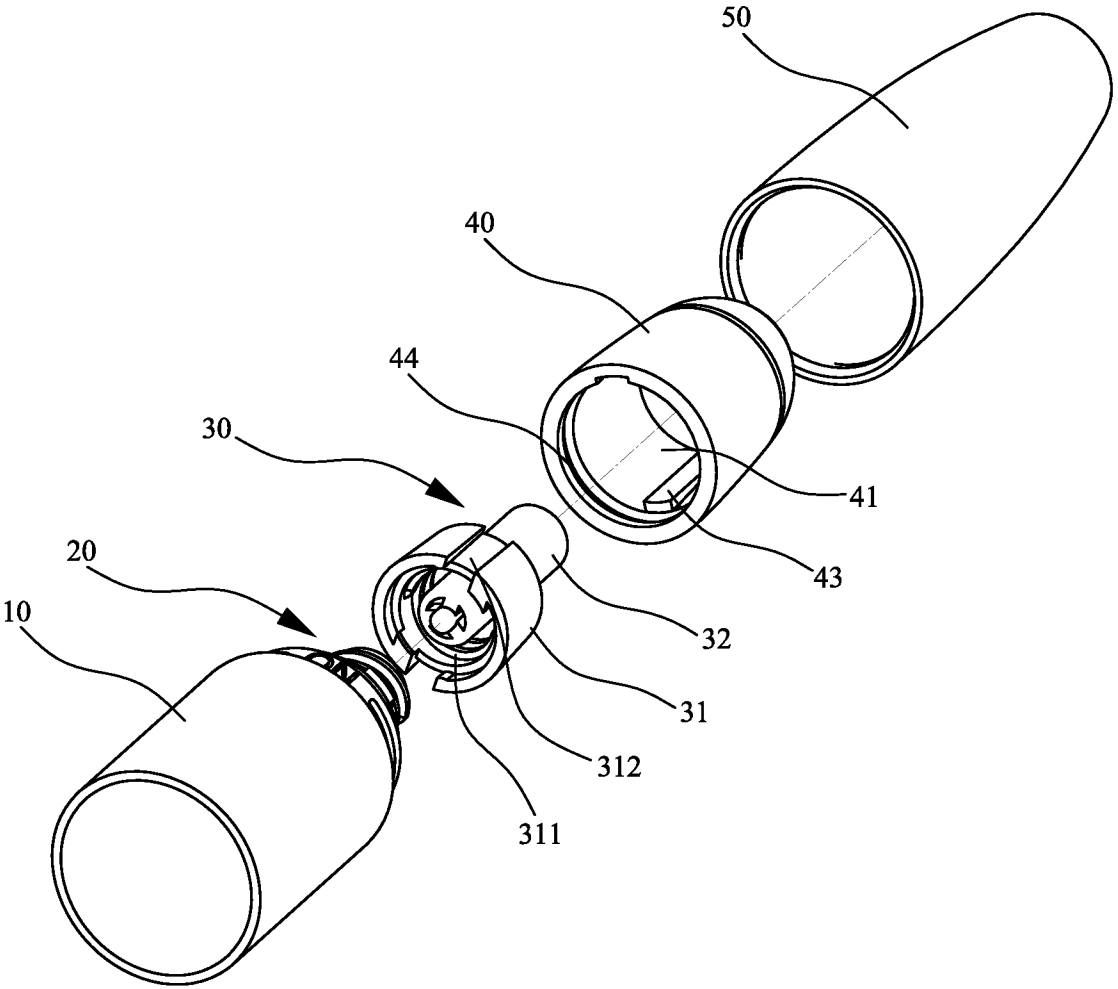
FIG. 1 is an exploded view in accordance with a first embodiment of the present invention.

Embodiments of the present invention will now be described, by way of example only, with reference to the accompanying drawings.

As shown in FIG. 1 to FIG. 10, the present invention discloses a plastic soft tube with a cap structure able to control outflow, and comprises a tube main body 10, a main body connector 20 integrated with the tube main body 10, and an outer cap 50 fitted on the main body connector 20. The main body connector 20 is provided with an inner cap 30 screwed to the main body connector 20 and a middle cap 40 connected to the main body connector 20 and fitted on the inner cap 30. The main body connector 20 has an outlet 241 therein. The inner cap 30 includes a protruding post 32 thereon. The protruding post 32 has a first passageway 321 therein. A lower end of the protruding post 32 is connected with a protrusion 322 for the first passageway 321 selectively to communicate with the outlet 241 or not to communicate with the outlet 241. The middle cap 40 has a post hole 42 corresponding to the protruding post 32. The middle cap 40 and the inner cap 30 are movably mated with each other. When the middle cap 40 is turned, the inner cap 30 is brought to move up and down relative to the main body connector 20.

A First Embodiment

Figure 2:
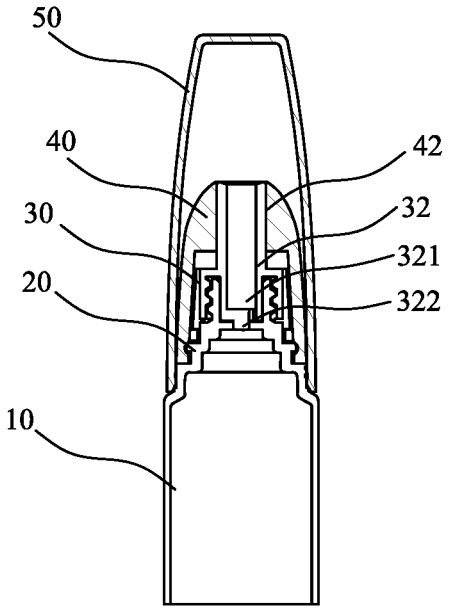
FIG. 2 is a sectional view in accordance with the first embodiment of the present invention.
Figure 3:
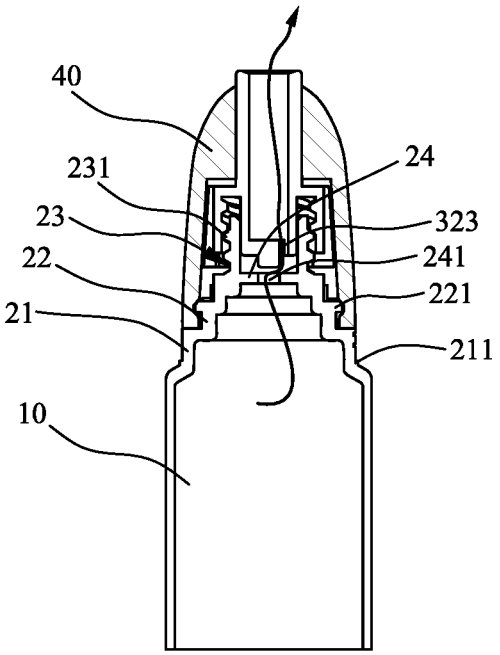
FIG. 3 is a schematic view in accordance with the first embodiment of the present invention when in use.

As shown in FIG. 1 to FIG. 3, the present invention discloses a plastic tube with a cap structure able to control flow, and comprises a tube main body 10, a main body connector 20 integrated with the tube main body 10, an inner cap 30 connected with the main body connector 20, a middle cap 40 fitted on the inner cap 30 and connected with the main body connector 20, and an outer cap 50 fitted on the middle cap 40 and the main body connector 20.

The main body connector 20 has a first neck 21 relative to the tube main body 10. An outer edge of the first neck 21 is formed with a flange 211 for engagement of the outer cap 50. An upper end of the first neck 21 is formed with a second neck 22. An outer end of the second neck 22 is formed with another flange 221 for engagement of the middle cap 40. An upper end of the second neck 22 is formed with a third neck 23 for connection of the inner cap 30. An outer wall of the third neck 23 is formed with outer threads 231. An inner side of the main body connector 20, between the second neck 22 and the third neck 23, is provided with a baffle 24. The baffle 24 is formed with an outlet 241 for the liquid or paste in the tube main body 10 to flow out.

The inner cap 30 is connected to the third neck 23 of the main body connector 20 and has a cap body 31 corresponding to the third neck 23. An inner wall of the cap body 31 is formed with inner threads 311 to mate with the outer threads 231 of the third neck 23. An outer wall of the cap body 31 is formed with two longitudinal grooves 312. An upper end of the cap body 31 is formed with a protruding post 32. The protruding post 32 is formed with a first passageway 321 therein. One end of the protruding post 32 is connected with the cap body 31 and extends into the cap body 31. The lower end of the protruding post 32 extends into the cap body 31 to form a protrusion 322 which is level with the lower end edge of the cap body 31 and is in a pillar configuration to fit the outlet 241. The periphery of the junction of the protrusion 322 and the protruding post 32 is formed with three perforations 323 in communication with the first passageway 321 of the protruding post 32.

The middle cap 40 is connected to the main body connector 20 and fitted on the inner cap 30. The inner wall of the bottom of the middle cap 40 is formed with an annular groove 44 to mate with the flange 221 of the second neck 22. The middle cap 44 has an accommodation space 41 therein corresponding to the cap body 31 of the inner cap 30. The accommodation space 41 is greater than the cap body 31 of the inner cap 30, so that the cap body 31 of the inner cap 30 can be moved up and down within the accommodation space 41. The upper end of the middle cap 40 is formed with a post hole 42 which is in communication with the accommodation space 41 and mated with the protruding post 32 of the inner cap 30.

The outer cap 50 is connected to the main body connector 20 and fitted on the main body connector 20 and the middle cap 40.

When the present invention is in an assembled state, the inner cap 30 is connected to the third neck 23 of the main body connector 20 by means of the inner threads 311 of the cap body 31 of the inner cap 30 to mate with the outer threads 231 of the third neck 23, such that the inner cap 30 and the main body connector 20 are connected together. At this moment, the protrusion 322 of the protruding post 32 is to seal the outlet 241 of the baffle 24. The inner wall of the middle cap 40 is provided with engaging blocks 43 corresponding to the grooves 312 of the cap body 31 of the inner cap 30. The middle cap 40 is connected to the second neck 22 of the main body connector 20. The flange 221 of the second neck 22 is engaged in the annular groove 44 of the middle cap 40, such that the middle cap 40 and the main body connector 20 are connected together. The cap body 31 of the inner cap 30 is placed in the accommodation space 41 of the middle cap 40, and there is a certain distance defined between the upper edge of the cap body 31 and the accommodation space 41. The protruding post 32 of the inner cap 30 is inserted through the post hole 42 of the middle cap 40. The upper end edge of the protruding post 32 is level with the upper end edge of the post hole 42. The outer cap 50 is connected to the first neck 21 of the main body connector 20. The main body connector 20 and the middle cap 40 are covered by the outer cap 50. In the assembled state, the protrusion 322 of the protruding post 32 of the inner cap 30 blocks the outlet 241, so that the liquid or paste in the tube main body 10 cannot flow out.

When in use, the outer cap 50 is opened and the middle cap 40 is turned relative to the tube main body 10. Because the middle cap 40 is mated with the inner cap 30 through the engaging blocks 43 and the grooves 312, the inner cap 30 will be turned along with the middle cap 40 when the middle cap 40 is turned. That is, the inner cap 30 is turned upward relative to the main body connector 20, and the protrusion 322 of the protruding post 32 of the inner cap 30 is moved upward to disengage from the outlet 241. The tube main body 10 is applied with a force and squeezed, so that the liquid or paste in the tube main body 10 flows through the outlet 241 and the perforations 323 to enter the first passageway 321 and then flows out from the first passageway 321. By controlling the rotation of the outer cap 50, the gap between the protrusion 322 of the protruding post 32 of the inner cap 30 and the outlet 241 is controllable so as to control the outflow.

A Second Embodiment

Figure 4:
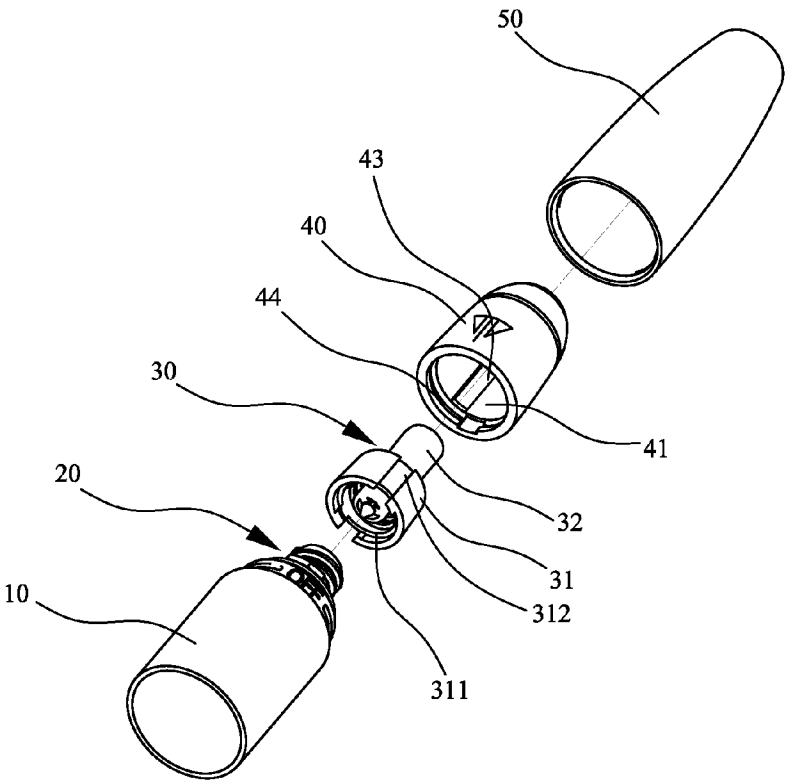
FIG. 4 is an exploded view in accordance with a second embodiment of the present invention.
Figure 5:
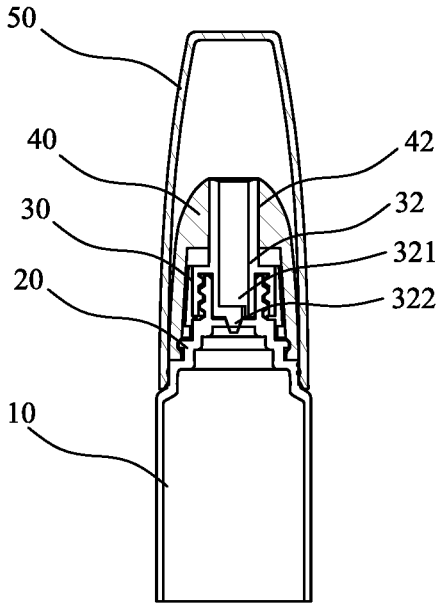
FIG. 5 is a sectional view in accordance with the second embodiment of the present invention.
Figure 6:
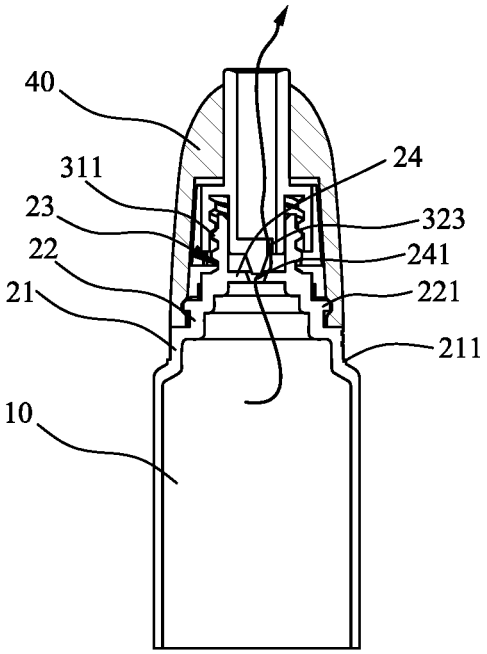
FIG. 6 is a schematic view in accordance with the second embodiment of the present invention when in use.
Figure 7A:
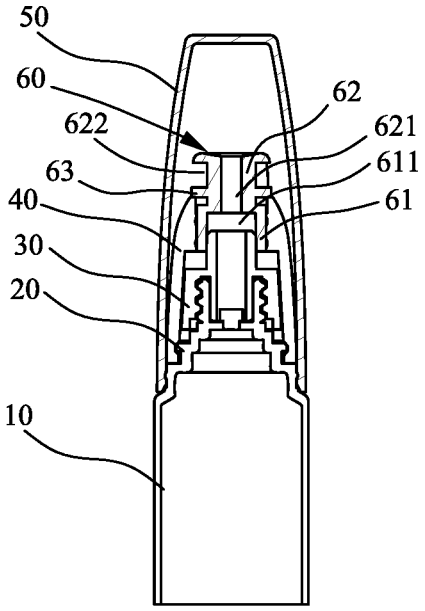
FIG. 7A is a partial sectional view in accordance with a third embodiment of the present invention.
Figure 7B:
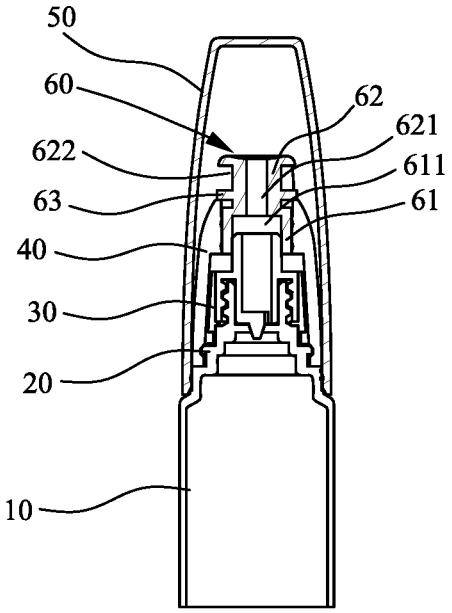
FIG. 7B is another partial sectional view in accordance with the third embodiment of the present invention.
Figure 8A:
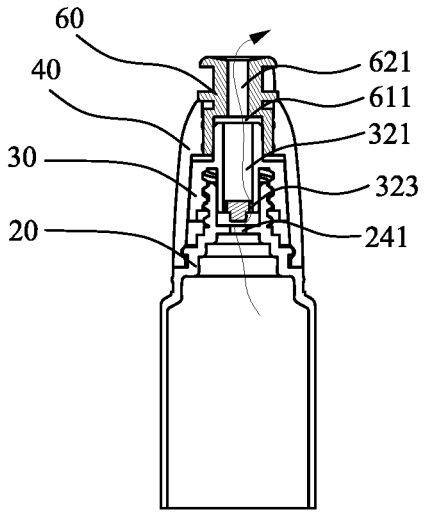
FIG. 8A is a partial schematic view in accordance with the third embodiment of the present invention when in use.
Figure 8B:
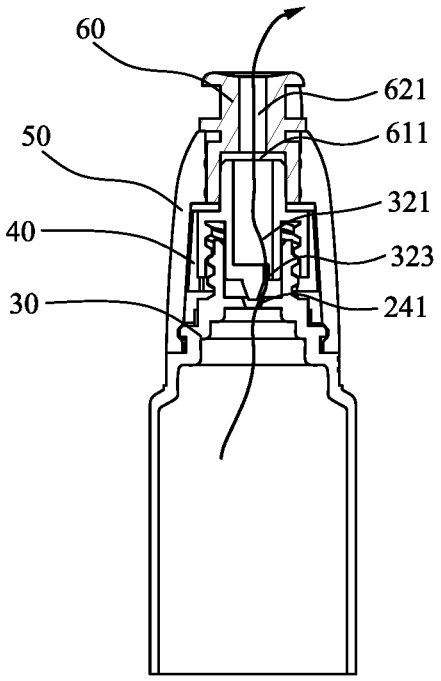
FIG. 8B is another partial schematic view in accordance with the third embodiment of the present invention when in use.
Figure 9:
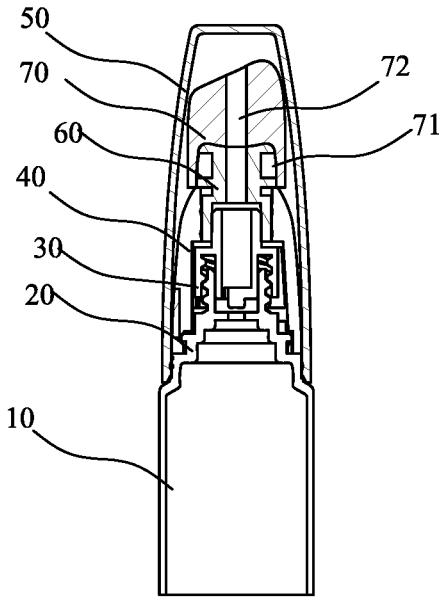
FIG. 9 is a sectional view in accordance with the third embodiment of the present invention.
Figure 10:
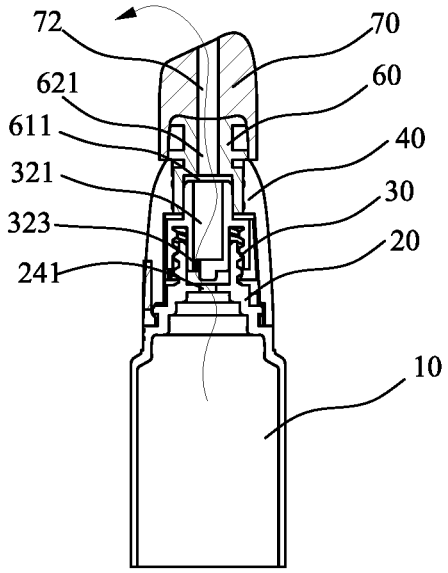
FIG. 10 is a schematic view in accordance with the third embodiment of the present invention when in use.

As shown in FIG. 4 to FIG. 6, the second embodiment is substantially similar to the first embodiment with the exceptions described hereinafter. In the second embodiment, the outlet 241 of the baffle 24 of the main body connector 20 is a taper configuration, and the protrusion 322 of the protruding post 32 of the inner cap 30 is also a taper configuration corresponding to the outlet 241.

The second embodiment is based on the first embodiment to achieve a less outflow.

A Third Embodiment

As shown in FIG. 7A to FIG. 10, the third embodiment is based on the first embodiment and the second embodiment. The present invention further comprises an inner fitting head 60 and an outer fitting head 70. The inner fitting head 60 is installed on the middle cap 40. The outer fitting head 70 is fitted on the inner fitting head 60. The arrangement of the inner fitting head 60 is convenient for connection of the outer fitting head 70.

The inner fitting head 60 and the outer fitting head 70 may be an integral whole.

The inner fitting head 60 has a connecting section 61 corresponding to the post hole 42 of the middle cap 40. The connecting section 61 is located in the post hole 42 of the middle cap 40. The connecting section 61 has an accommodation hole 611 to accommodate the protruding post 32 of the inner cap 30. An upper end of the accommodation hole 611 is formed with a second passageway 621 in communication with the accommodation hole 611. An upper portion of the inner fitting head 60 is formed with a flange 63 to engage with the outer side of the middle cap 40. An upper end of the flange 63 is formed with a coupling section 62. The coupling section 62 has an engaging groove 622 thereon.

A lower end of the outer fitting head 70 is formed with a coupling hole 71 to mate with the coupling section 62. An inner wall of the coupling hole 71 is provided with a flange to mate with the engaging groove 622 of the inner fitting head 60. An upper end of the coupling hole 71 is formed with a third passageway 72 in communication with the coupling hole 71. An upper end of outer fitting head 71 is formed with a concave curved surface, such that the liquid or paste can be smeared conveniently.

When in use, the liquid or paste in the tube main body 10 flows through the outlet 241 and the perforations 323 to enter the first passageway 321 of the protruding post 32, and then flows through the second passageway 621 of the inner fitting head 62 to come out of the third passageway 72 of the outer fitting head 70. After the liquid or paste in the tube main body 10 flows out, it can be smeared through the outer fitting head 70.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A plastic soft tube with a cap structure able to control outflow, comprising a tube main body, a main body connector integrated with the tube main body, and an outer cap fitted on the main body connector, characterized in that: the main body connector is provided with an inner cap screwed to the main body connector and a middle cap connected to the main body connector and fitted on the inner cap; the main body connector has an outlet therein, the inner cap comprises a protruding post thereon, the protruding post has a first passageway therein, a lower end of the protruding post is connected with a protrusion for the first passageway selectively to communicate with the outlet or not to communicate with the outlet, the middle cap has a post hole corresponding to the protruding post; the middle cap and the inner cap are movably mated with each other, when the middle cap is turned, the inner cap is brought to move up and down relative to the main body connector; an inner fitting head connected to the post hole of the middle cap and an outer fitting head fitted on the inner fitting head; wherein the inner fitting head has a connecting section corresponding to the post hole of the middle cap, the connecting section has an accommodation hole to accommodate the protruding post of the inner cap, an upper end of the accommodation hole is formed with a second passageway in communication with the accommodation hole; a lower end of the outer fitting head is formed with a coupling hole to connect with the inner fitting head, and an upper end of the coupling hole is formed with a third passageway in communication with the coupling hole.

2. The plastic soft tube with a cap structure able to control outflow as claimed in claim 1, wherein the protrusion is in a pillar configuration or a taper configuration, and the outlet is a pillar configuration or a taper configuration corresponding to the protrusion.

3. The plastic soft tube with a cap structure able to control outflow as claimed in claim 1, wherein the inner cap has a cap body corresponding to the main body connector, an outer wall of the cap body is formed with at least one groove, the middle cap has an accommodation space therein corresponding to the cap body of the inner cap, and an inner wall of the accommodation space is provided with at least one engaging block corresponding to the groove of the cap body of the inner cap.

4. The plastic soft tube with a cap structure able to control outflow as claimed in claim 3, wherein the accommodation space of the middle cap is greater than the cap body of the inner cap.

5. The plastic soft tube with a cap structure able to control outflow as claimed in claim 3, wherein the main body connector relative to the tube main body from bottom to top is provided with a first neck to mate with the outer cap, a second neck to mate with the middle cap, and a third neck to mate with the inner cap, outer edges of the first neck and the second neck are formed with flanges to mate with the outer cap and the middle cap, an outer wall of the third neck is formed with outer threads, and an inner wall of the cap body is formed with inner threads to mate with the outer threads of the third neck.

6. The plastic soft tube with a cap structure able to control outflow as claimed in claim 5, wherein an inner side of the main body connector, between the second neck and the third neck, is provided with a baffle, and the outlet is formed on the baffle.

7. The plastic soft tube with a cap structure able to control outflow as claimed in claim 1, wherein a periphery of the junction of the protruding post and the protrusion is formed with at least one perforation in communication with the first passageway of the protruding post.

8. The plastic soft tube with a cap structure able to control outflow as claimed in claim 1, wherein the inner fitting head and the outer fitting head are an integral whole.

* * * * *